US008807528B2

(12) United States Patent
Udipi

(10) Patent No.: US 8,807,528 B2
(45) Date of Patent: Aug. 19, 2014

(54) SELECTIVE TORQUE OPERATOR FOR A VALVE

(75) Inventor: Mahesha Udipi, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 930 days.

(21) Appl. No.: 12/909,235

(22) Filed: Oct. 21, 2010

(65) Prior Publication Data

US 2012/0097877 A1 Apr. 26, 2012

(51) Int. Cl.
*E21B 34/02* (2006.01)

(52) U.S. Cl.
USPC ..... 251/250.5; 251/337

(58) Field of Classification Search
USPC ..... 251/248, 250.5, 337; 74/508, 670
See application file for complete search history.

(56) References Cited

U.S. PATENT DOCUMENTS

| | | | | |
|---|---|---|---|---|
| 1,905,845 | A * | 4/1933 | Fuchs | 74/505 |
| 2,674,903 | A * | 4/1954 | Doster | 74/508 |
| 3,329,243 | A * | 7/1967 | Gibb | 188/134 |
| 4,082,247 | A * | 4/1978 | Dalton | 251/229 |
| 4,338,961 | A | 7/1982 | Karpenko | |
| 4,484,492 | A * | 11/1984 | Cadic | 74/625 |
| 4,994,001 | A * | 2/1991 | Wilkinson et al. | 475/4 |
| 5,166,677 | A * | 11/1992 | Schoenberg | 340/853.3 |
| 7,837,175 | B2 | 11/2010 | Stone et al. | |
| 2011/0277985 | A1 | 11/2011 | Mosman | |

FOREIGN PATENT DOCUMENTS

| | | | |
|---|---|---|---|
| CN | 201705286 | U | 1/2011 |
| GB | 1318830 | A | 5/1973 |
| GB | 2280003 | A | 1/1995 |

OTHER PUBLICATIONS

GB Search Report dated Jan. 31, 2012 from corresponding Application No. GB1117969.4.
GB Partial Search Report dated Dec. 15, 2011 from corresponding Application No. GB1117969.4.

* cited by examiner

*Primary Examiner* — John Bastianelli
(74) *Attorney, Agent, or Firm* — Bracewell & Giuliani LLP

(57) ABSTRACT

A low torque operator for selectively engaging a gear unit in an actuating drive stem of a valve having a collar with an axial bore and a slot through its side. The slot includes a projection directed towards an upper end of the collar and has an edge oriented oblique to the collar axis. A drive shaft inserts in the bore, and a pin mounted in the drive shaft engages the slot during low torque conditions. The operator also includes an idler gear and a bullgear. A driven shaft with two drive pins inserts into the bore on a lower side of the collar. The upper of the two pins remains in contact with a shoulder formed on a lower end of the collar during low torque conditions. The lower of the two pins engages a shoulder formed on a lower side of the bullgear during high torque conditions.

19 Claims, 4 Drawing Sheets

SELECTIVE TORQUE OPERATOR FOR A VALVE

FIELD OF THE INVENTION

This invention relates in general to production of oil and gas wells, and in particular to a device for reducing the torque required to actuate a valve.

DESCRIPTION OF RELATED ART

Surface wellbores are formed through subterranean formations lying underneath the surface. Systems for producing oil and gas from surface wellbores typically include a wellhead assembly set over a wellbore opening. A typical surface wellhead assembly includes a high pressure wellhead housing supported in a lower pressure wellhead housing and secured to conductor casing that extends downward past the wellbore opening. Wells are generally lined with one or more casing strings coaxially inserted through, and significantly deeper than, the conductor casing. The casing strings are suspended from casing hangers landed in the wellhead housing. One or more tubing strings are provided within the innermost casing string; that among other things are used for conveying well fluid produced from the underlying formations. A production tree mounts to the upper end of the wellhead housing for controlling the well fluid. The production tree is typically a large, heavy assembly, having a number of valves and controls mounted thereon The valves may be gate valves that can be manually operated by a hand wheel. To actuate a gate in these types of valves, an operator must exert a rotational force, or torque, on the hand wheel. Due to the high pressures experienced by the gate at the break open or full close positions, a higher torque is required at these positions, which may be very difficult or even impossible for one or even two operators to apply. As such, gears that reduce the required torque on the hand wheel in exchange for having to rotate the hand wheel through a larger number of turns have been developed. However, once the high torque conditions are overcome, the torque needed to operate the valve through the intermediate gate positions decreases significantly. Thus, the large number of turns required results in additional time and effort spent by the operator turning the hand wheel even after the high torque conditions are overcome. This can be both costly and wasteful.

A technique is thus desirable that allows an operator to overcome the high torque conditions with low operating effort, while reducing the number of turns required once the high torque conditions are overcome.

SUMMARY OF THE INVENTION

In an example embodiment a hand-operated valve includes a member or stem that is stroked open and closed by a shaft that can rotate. The valve also includes a torque selector for selectively engaging a gear unit in an actuating drive stem of the valve. The selector has a collar with an axial bore and a slot through its side. The slot includes a projection directed towards an upper end of the collar and has an edge oriented oblique to the collar axis. A driven shaft inserts in the bore, and a first pin mounted in the driven shaft engages the projection in the slot during low torque conditions, which are typically present at valve positions intermediate to open and close. Further, a second pin mounted on the valve stem located below the first pin engages a shoulder formed on a lower end of the collar, also during low torque conditions.

This results in a direct drive mechanism of the valve stem which allows for a low number of turns, as compared to high torque conditions, to operate the valve stem.

When the effort an operator exerts on the hand wheel increases due to high torque conditions in the valve stem, the force generated by the operator overcomes a preset load of a spring coupled to the drive shaft at one end and collar at the other end. The force generated by the operator also causes the first pin mounted on the shaft to ride down an inclined edge in the projection, disengaging the first pin from the projection in the collar. In addition, the exerted force causes the torque selector and bullgear to move upward relative to the housing, causing the second pin mounted on the stem to disengage from the lower shoulder on the collar. A third or bull gear pin that is mounted on the stem at the same time engages a shoulder formed on a lower portion of the bull gear as the bull gear moves upward. With the bull gear pin engaged to the bull gear, the full mechanical advantage of the gear unit is advantageously utilized to overcome the torque at the stem. This mechanical advantage allows a single operator to actuate the valve without additional operators and with less operating effort. Further, once the high torque conditions are overcome, the torque selector allows the gear mechanism to revert to the direct drive, low torque mechanism, either automatically or selectively, to allow quicker operation of the valve as compared to the high number of turns associated with the high torque condition.

DETAILED DESCRIPTION OF THE INVENTION

Figure 1:
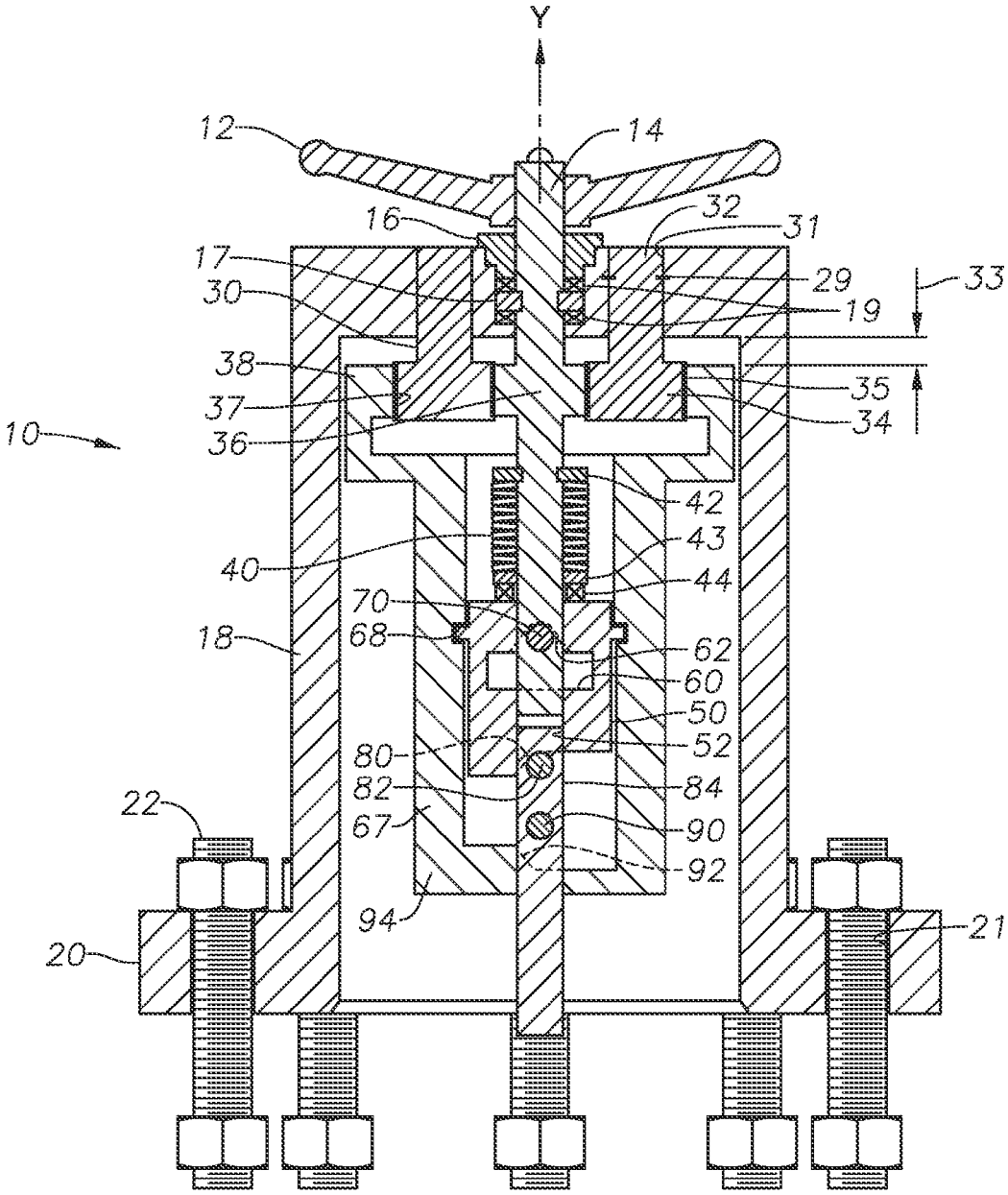
FIG. 1 is a side sectional view of an example embodiment of a gate valve operator with a torque selector mechanism in direct drive engagement, in accordance with the present invention.

The apparatus and method of the present disclosure will now be described more fully hereinafter with reference to the accompanying drawings in which embodiments are shown. This subject of the present disclosure may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout. For the convenience in referring to the accompanying figures, directional terms are used for reference and illustration only. For example, the directional terms such as "upper", "lower", "above", "below", and the like are being used to illustrate a relational location.

It is to be understood that the subject of the present disclosure is not limited to the exact details of construction, operation, exact materials, or embodiments shown and described, as modifications and equivalents will be apparent to one skilled in the art. In the drawings and specification, there have been disclosed illustrative embodiments of the subject disclosure and, although specific terms are employed, they are used in a generic and descriptive sense only and not for the purpose of limitation. Accordingly, the subject disclosure is therefore to be limited only by the scope of the appended claims.

Referring to FIG. 1, a sectional view of an embodiment of a gate valve actuator or operator 10 is shown. The valve actuator includes a housing a hand wheel 12 operably connected to a drive shaft 14 that is rotatable about an axis Y. The drive shaft 14 is centrally retained with the actuator 10 by a lock nut 16 and a washer 17. In this example, bearings 19 are located on either side of the washer 17 to provide radial support at and facilitate rotation of the shaft 14. The lock nut 16 threadingly engages an opening centrally located on an upper surface of a housing 18 of the actuator 10. The housing 18 has a flanged lower end 20 having a plurality of circumferentially spaced apart bolt openings 21 therethrough, each for receiving a stud or bolt 22 with two nuts. The studs 22 may be used to connect the actuator 10 to a valve (not shown).

Continuing to refer to FIG. 1, at least one idler gear 30 has an upper end 32 that is retained by a snap ring 29 within an opening 31 formed at an upper end of the housing 18. A lower portion 34 of the idler gear 30 extends downward into the housing 18. A gap 33 is defined between the interior of the housing 18 and an upper surface of the lower portion 34. In this example, the lower portion 34 of the idler gear 30 has a larger diameter than the upper portion 32 and has teeth 35 formed thereon that engage teeth formed on a pinion 36 that is connected to the drive shaft 14. The pinion 36 rotates as the drive shaft 14 is rotated and thereby causes the lower portion 34 of the idler gear 30 to rotate. A bull gear 38 is located within the housing 18 and, in this embodiment, circumscribes the idler gear 30. Because the idler gear teeth 35 simultaneously engages teeth 37 on the bull gear 38, the bull gear 38 will also rotate as the idler gear 30 rotates. The bull gear 38 is engaged during high torque conditions to provide mechanical advantage and is described in more detail in a subsequent section.

Figure 3:
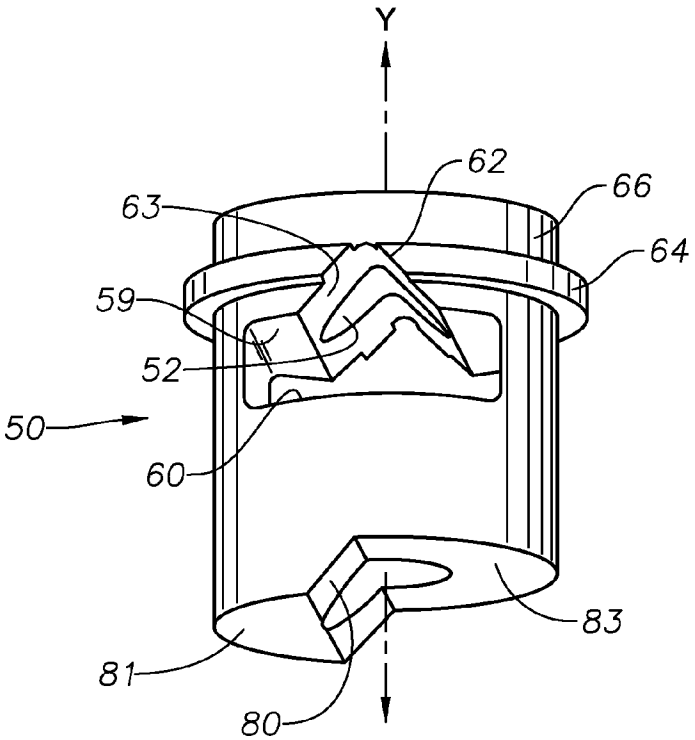
FIG. 3 is a perspective view of an example embodiment of the torque selector mechanism of FIG. 1.
Figure 2:
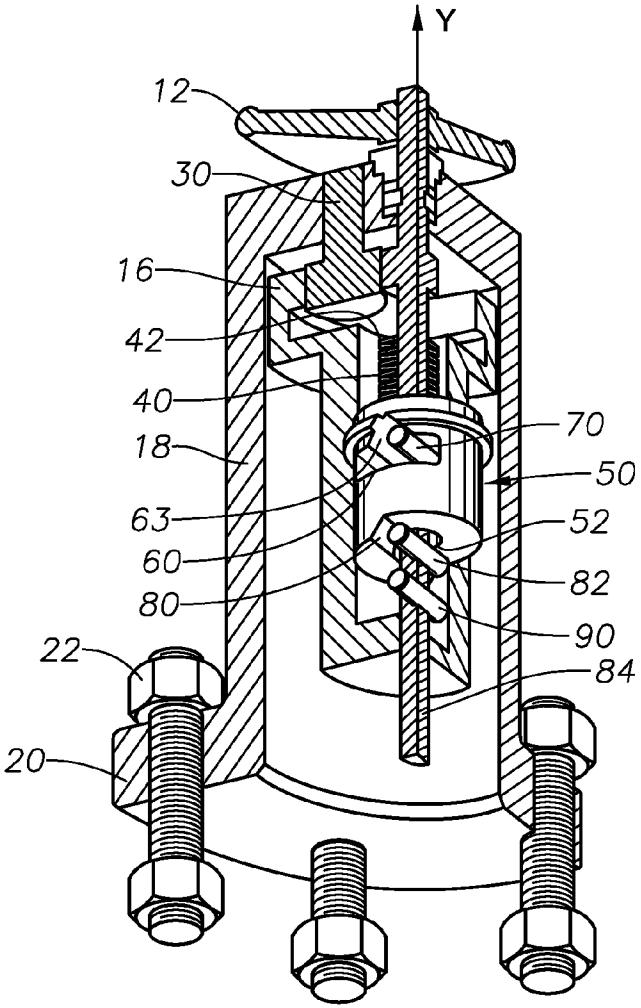
FIG. 2 is a perspective partial sectional view of an example embodiment of gate valve operator of FIG. 1.

A spring 40 having a preset load circumscribes a portion of the drive shaft 14 below the pinion gear 36 and is retained within a set of washers or snap rings 42. An upper snap ring 42 is shown circumscribing and anchored to the drive shaft 14 at an upper end of the spring 40, a lower snap ring 43 circumscribes the drive shaft 14 at the lower end of the spring 40. A bearing 44 is located between the bottom washer 42 and an upper surface of a torque selector or collar 50. The collar 50 is provided with a bore 52 to centralize the drive shaft 14 within the housing 18. The torque selector 50 allows for engagement and disengagement of the bull gear 38 mechanism depending on the torque conditions. As shown in FIGS. 2 and 3, the bore 52 has an axis that coincides with the axis of the actuator 10, in this example. The selector 50 has a slot 60 formed on its side that in this embodiment extends through the selector 50. A portion of the slot 60 is profiled upward to define a projection 62 shown directed towards an upper end 66 (FIG. 3) of the collar 50. The upwardly depending sides of the projection 62 form an edge 63 oriented oblique to the axis Y of the collar 50. The projection 62 intersects a radially protruding lip 64 that circumscribes the outer surface of the collar 50. Referring back to FIG. 1, the lip 64 is received by a circumferential recess or groove 68 formed on an interior surface of a lower body 67 of the bull gear 38. The lip 64 thereby retains the torque selector 50 within the lower body 67 of the bull gear 38. The lower body 67 in this example has an annular cross section and depends downward from toothed portion of the bull gear 38.

Continuing to refer to FIG. 1, the drive shaft 14 inserts in the bore 52, and a pin 70 radially mounted at a lower portion of the drive shaft 14 engages the projection 62 of the slot 60 during low torque conditions. In this embodiment, a shoulder 80 on a lower end of the collar 50 is oblique to the axis of the collar 50 and defines two offset lower surfaces 81, 83 (FIG. 3). A stem 84 (or driven shaft) inserts into the lower end of the collar 50 through the bore 52. During low torque conditions, a second pin 82 mounted on an upper portion of the stem 84 engages the shoulder 80 to thereby transfer rotation from the drive shaft 14 to the stem 80. The stem 80 extends downwards and out of a lower end of housing 18, in an example the lower end of the stem 80 can be used to actuate a gate (not shown).

Figure 4:
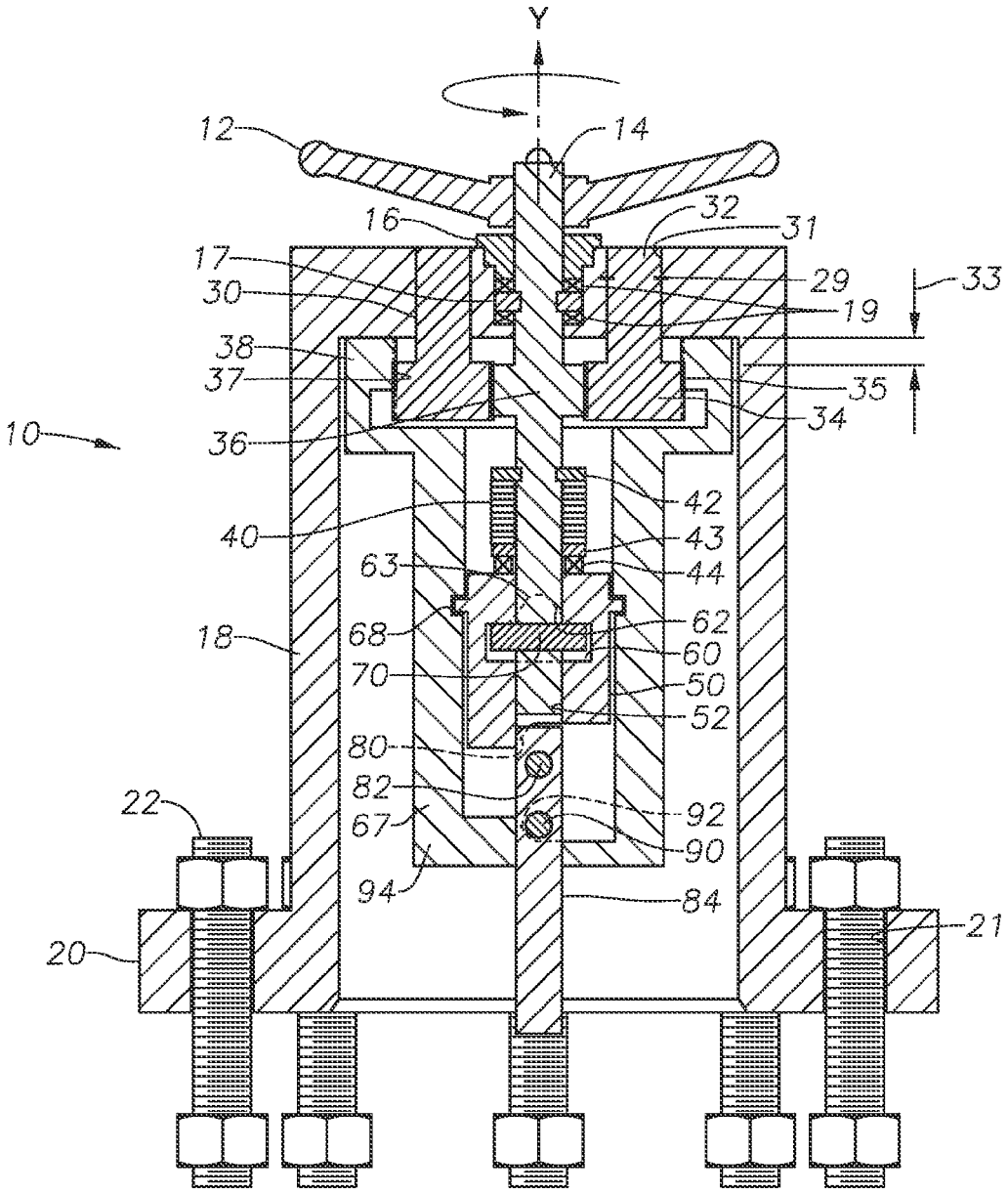
FIG. 4 is a side sectional view of an example embodiment of a gate valve operator with the torque selector mechanism in torque reduction engagement to apply mechanical advantage to a stem, in accordance with the present invention.

Referring to FIG. 4, the actuator 10 is shown in the high torque engaged position. In this position, the pin 70 on drive shaft 14 is disengaged from the projection 62 of the collar 50 and the pin 82 on the stem 84 is disengaged from the lower shoulder 80 on the lower end of the collar 50. The disengagement of the first and second pins 70, 82 occurs by applying a sufficient torque to the hand wheel 12 to overcome the preset load of the spring 40, thereby compressing the spring 40 and causing the bull gear 38 and collar 50 to move upwards with respect to the stem 84. A third pin or bull gear pin 90 is mounted to the stem 84 at a point below the second pin 82. The bull gear pin 90 engages a shoulder 92 formed on the interior of a lower end 94 of the bull gear lower body 67. In this example embodiment, the shoulder 92 is oblique to the axis of the actuator 10. The bull gear pin 90 allows the mechanical advantage of the bull gear 30 to increase the torque applied to the drive shaft 14 by a person and thereby transmit the increased torque to the stem 84, allowing operation of the gate (not shown). In this embodiment, the gear ratio between the pinion 36 driven by the shaft 14 and the idler gear 30 may be about 1:1. In an example embodiment, between the pinion 36 and the bull gear 38, the gear ratio is about 1:8, which can translate to $\frac{1}{8}^{th}$ of a rotation for the bull gear 38 for one rotation of the pinion 36. Thus, when the bull gear 38 is engaged to the stem 84 via the bull gear pin 90, one rotation of the pinion 36 will also turn the stem 84 $\frac{1}{8}^{th}$ of a rotation. Further, the stem 84 in this embodiment can have a pitch, or threads per inch, of ⅛, which translates to ⅛" travel in the stem 84 per revolution of the stem 84. As a result, the gate (not shown) would axially move by that amount.

In operation, when the effort the operator exerts on the drive shaft 14 via the hand wheel 12 increases due to high torque conditions in the valve stem 84, the force generated by the operator overcomes a preset load of a spring 40 coupled to the drive shaft 14 at one end and collar 50 at the other end. The force generated by the operator causes the first pin 70 mounted on the shaft 14 to ride down the inclined edge 63 in the projection 62 (FIGS. 2 and 3) to draw the collar 50 and bull gear lower body 67 upwards toward the spring 40. The upward movement of the collar 50 disengages the first pin 70 from the projection 62 in the collar 50. As the first pin 70 rides down the inclined edge and reaches a horizontal edge 59, the bull gear 38 and torque selector 50 connected to the bull gear 38, are forced upwards by an amount defined by a height of the projection 62 formed in the slot 60. This upward movement relative to the housing 18 and the drive shaft 14 disengages the first pin 70 from the projection 62 and hence the torque selector 50 and also causes the second pin 82 mounted on the stem 84 to disengage from the lower shoulder 80 on the selector 50. A third or bull gear pin 90 that is mounted on the stem 84 engages a shoulder 92 formed on a lower portion 94 of the bull gear 38 as the bull gear 38 moves upward. In this embodiment, a minimal counter turn may be required at the end of an open or close cycle to engage the first pin 70 for direct drive once the high torque is satisfied.

Once the bull gear pin 90 is engaged to the bull gear 38, the rotational force or torque is transferred to the stem 84 from a larger diameter of the bull gear 38, thereby increasing the torque input to the handwheel 12 for application to the stem 84. This mechanical advantage provided by the bull gear 38 is advantageously utilized to overcome the torque at the stem 84. This mechanical advantage allows a single operator to actuate the valve without additional operators and with less operating effort. As explained previously, the torque selector 50 returns the gear mechanism to the direct drive mechanism upon a counter turn of the hand wheel 12 to slide the pin 70 back into the projection 62 to allow quicker operation of the valve due to the low number of turns needed from the stem 84 to cause the gate (not shown) to axially travel a determined length.

Figure 5:
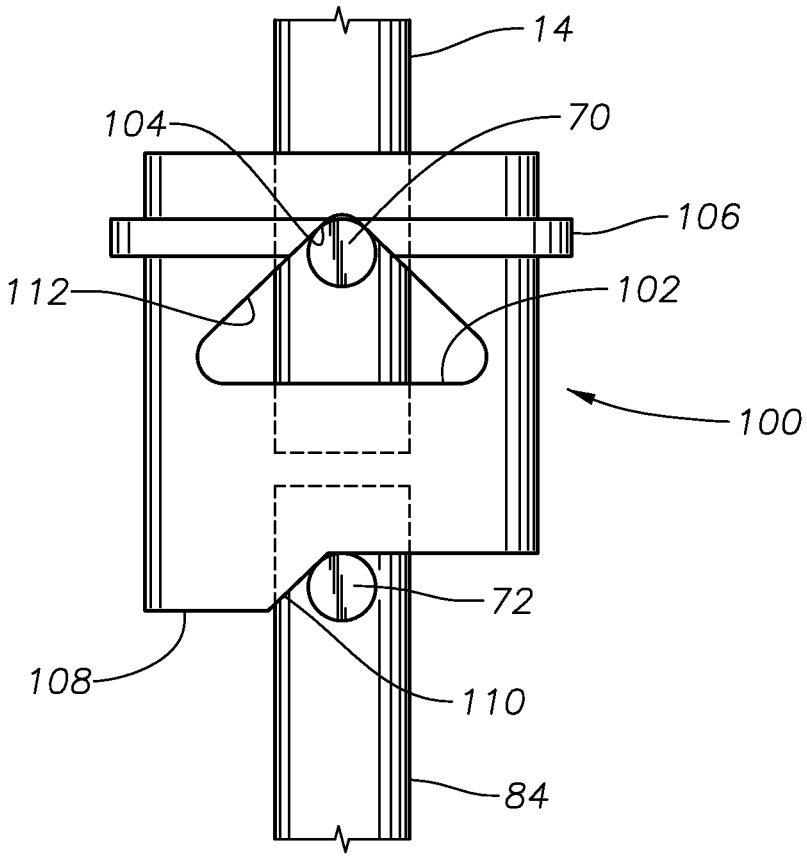
FIG. 5 is a side schematic view of an alternative embodiment of a portion of the torque selector mechanism of FIG. 1.

In another embodiment shown in FIG. 5, a torque selector or collar 100 has a slot 102 formed through a sidewall. The selector 100 has a projection 104 that projects upward to an upper end of the selector 100. A lip 106 is formed on the exterior of the selector 100 to allow the selector 100 to be retained within the bull gear 38 and has a lower shoulder 110 formed at a lower end 108 of the selector 100. In this embodiment, the pin 70 only rides along an oblique edge 112 of the slot 102 but does not reach a horizontal edge as in the previously described embodiments. The triangular shape of the slot 102 eliminates the need for the operator to counter turn the arrangement to engage the first pin 70 with the projection 104 as the gear mechanism will return to the low torque condition automatically whenever the operator releases the hand wheel 12.

While the invention has been shown or described in only some of its forms, it should be apparent to those skilled in the art that it is not so limited, but is susceptible to various changes without departing from the scope of the invention.

What is claimed is:

1. A valve for use in a wellhead assembly comprising:

a valve member that is stroked between open and closed positions by a rotatable shaft, the rotatable shaft having a drive member;

a torque selecting device operably associated with the rotatable shaft having a low torque position and a high torque position, the torque selecting device comprising a slot with an outer edge that is engaged by the drive member a spring member mounted on the rotatable shaft for urging the torque selecting device into a position for rotating engagement with the rotatable shaft; and a gear member in selective engagement with the torque selecting device, wherein, torque is coupled directly to the valve member through the rotatable shaft when the torque selecting device is in the low torque position;

torque is coupled from the rotatable shaft to the valve member through the gear member when the torque selecting device is in the high torque position; and the torque selecting device is automatically shifted to the high torque position when torque applied to the rotatable shaft is sufficient to overcome a preset load of the spring member to slide the drive member along the outer edge to axially move the torque selecting device and the gear member.

2. The valve of claim 1, wherein the torque selecting device comprises an annular collar with a profile that when in the low torque position engages an end of the rotatable shaft and when in the high torque position the collar is axially moved so the profile is disengaged from the shaft.

3. The valve of claim 2, wherein the rotatable shaft comprises a drive shaft and a driven shaft each rotatingly engaged with the collar.

4. The valve of claim 3, wherein the drive member is mounted on the drive shaft and the slot is formed in a sidewall of the collar, the drive shaft being rotatingly engaged with the collar by the drive member that contacts a portion of the outer edge of a slot, and wherein the portion of the outer edge contacted by the drive member is oriented oblique to an axis of the collar, so that when the drive member slides along the outer edge in a direction that approaches the end of the collar having the profile, the collar is disengaged from the drive shaft.

5. The valve of claim 3, wherein the profile comprises a shoulder formed on a lower end of the collar that contacts a first drive member provided on the driven shaft when the torque selecting device is in the low torque position.

6. The valve of claim 5, wherein when the drive member on the drive shaft slides along the edge of the slot towards the profile, the collar is moved axially so that the profile is urged axially away from the first drive member on the driven shaft.

7. The valve of claim 3, wherein a portion of the slot projects in a direction away from the profile with lateral sides oriented oblique to an axis of the collar that intersect to define a wedge shaped drive end of the slot.

8. The valve of claim 7, wherein when the drive member on the drive shaft slides along the lateral sides away from the drive end of the slot, the torque selecting device changes from the low torque position to the high torque position.

9. The valve of claim 3, wherein the spring member is mounted on the drive shaft and urges the collar into a position for rotating engagement with the drive shaft.

10. The valve of claim 3, further comprising a pinion operably connected to the drive shaft for driving the gear member.

11. The valve of claim 10, wherein the drive shaft is rotatingly engaged with the gear member by a second drive member mounted to the driven shaft that contacts a shoulder formed on an inner edge of a lower end of the gear member, when the torque selecting device is in a high torque position, the pinion transmitting torque to the driven shaft via the gear member.

12. The valve of claim 3, wherein the drive shaft drives the gear member via an idler gear operably connected between the drive shaft and the gear member.

13. A valve for use in a wellhead assembly comprising:

a valve member that is stroked between open and closed positions by a rotatable shaft;

a torque selecting device operably associated with the shaft having a low torque position and a high torque position, wherein the torque selecting device comprises an annular collar with a profile that when in the low torque position engages an end of the rotatable shaft and when in the high torque position the collar is axially moved so the profile is disengaged from the shaft, and a gear member in selective engagement with the torque selecting device, wherein, torque is coupled directly to the valve member through the rotatable shaft when the torque selecting device is in the low torque position; and torque is coupled from the rotatable shaft to the valve member through the gear member when the torque selecting device is in the high torque position.

14. The valve of claim 13, wherein the rotatable shaft comprises a drive shaft and a driven shaft each rotatingly engaged with the collar, wherein the drive shaft is rotatingly engaged with the collar by a drive member mounted to the drive shaft that contacts a portion of an outer edge of a slot formed in a sidewall of the collar, and wherein the portion of the outer edge contacted by the drive member is oriented oblique to an axis of the collar, so that when the drive member slides along the outer edge in a direction that approaches the end of the collar having the profile, the collar is disengaged from the drive shaft.

15. The valve of claim 14, wherein the profile comprises a shoulder formed on a lower end of the collar that contacts a first drive member provided on the driven shaft when the torque selecting device is in the low torque position.

16. The valve of claim 15, wherein when the drive member on the drive shaft slides along the edge of the slot towards the profile, the collar is moved axially so that the profile is urged axially away from the first drive member on the driven shaft.

17. The valve of claim 14, wherein a portion of the slot projects in a direction away from the profile with lateral sides oriented oblique to an axis of the collar that intersect to define a wedge shaped drive end of the slot, wherein when the drive member on the drive shaft slides along the lateral sides away from the drive end of the slot, the torque selecting device changes from the low torque position to the high torque position.

18. The valve of claim 14, further comprising a pinion operably connected to the drive shaft for driving the gear member, wherein the drive shaft is rotatingly engaged with the gear member by a second drive member mounted to the driven shaft that contacts a shoulder formed on an inner edge of a lower end of the gear member, when the torque selecting device is in a high torque position, the pinion transmitting torque to the driven shaft via the gear member.

19. The valve of claim 14, further comprising a spring member mounted on the drive shaft for urging the collar into a position for rotating engagement with both the drive shaft and the collar, wherein the torque selecting device is automatically shifted to the high torque position when torque applied to the drive shaft is sufficient to overcome a preset load exerted by the spring member to thereby axially move the collar and the gear member.

* * * * *